United States Patent [19]

Davis

[11] 4,092,225

[45] May 30, 1978

[54] HIGH EFFICIENCY PALLADIUM ELECTROPLATING PROCESS, BATH AND COMPOSITION THEREFOR

[75] Inventor: Thomas Francis Davis, Harrisburg, Pa.

[73] Assignee: AMP Incorporated, Harrisburg, Pa.

[21] Appl. No.: 808,754

[22] Filed: Jun. 22, 1977

Related U.S. Application Data

[63] Continuation-in-part of Ser. No. 742,482, Nov. 17, 1976, abandoned.

[51] Int. Cl.[2] ..... C25D 3/50; C09K 3/00

[52] U.S. Cl. ..... 204/47; 204/DIG. 2; 252/182

[58] Field of Search ..... 204/47, 43 N, 109, 123, 204/DIG. 2; 252/182; 106/1

[56] References Cited

U.S. PATENT DOCUMENTS

| | | | |
|---|---|---|---|
| 1,779,436 | 10/1930 | Keitel | 204/47 |
| 2,027,358 | 1/1936 | Powell et al. | 204/47 |
| 2,984,595 | 5/1961 | Schumpelt et al. | 204/47 X |
| 3,530,050 | 9/1970 | Hill et al. | 204/47 |
| 3,933,602 | 1/1976 | Henzi et al. | 204/47 X |

OTHER PUBLICATIONS

Johannes Fischer et al., "Precious Metal Plating," pp. 220–221, (1964).

*Primary Examiner*—G. L. Kaplan
*Attorney, Agent, or Firm*—Gerald K. Kita

[57] ABSTRACT

Palladium is electrodeposited from an aqueous bath comprising Pd $(NH_3)_2(NO_2)_2$ and tetrapotassium pyrophosphate at a pH of 8.5–11. Such a composition permits higher efficiencies to be obtained.

6 Claims, 2 Drawing Figures

HIGH EFFICIENCY PALLADIUM ELECTROPLATING PROCESS, BATH AND COMPOSITION THEREFOR

CROSS REFERENCE TO RELATED APPLICATION

Figure 1:
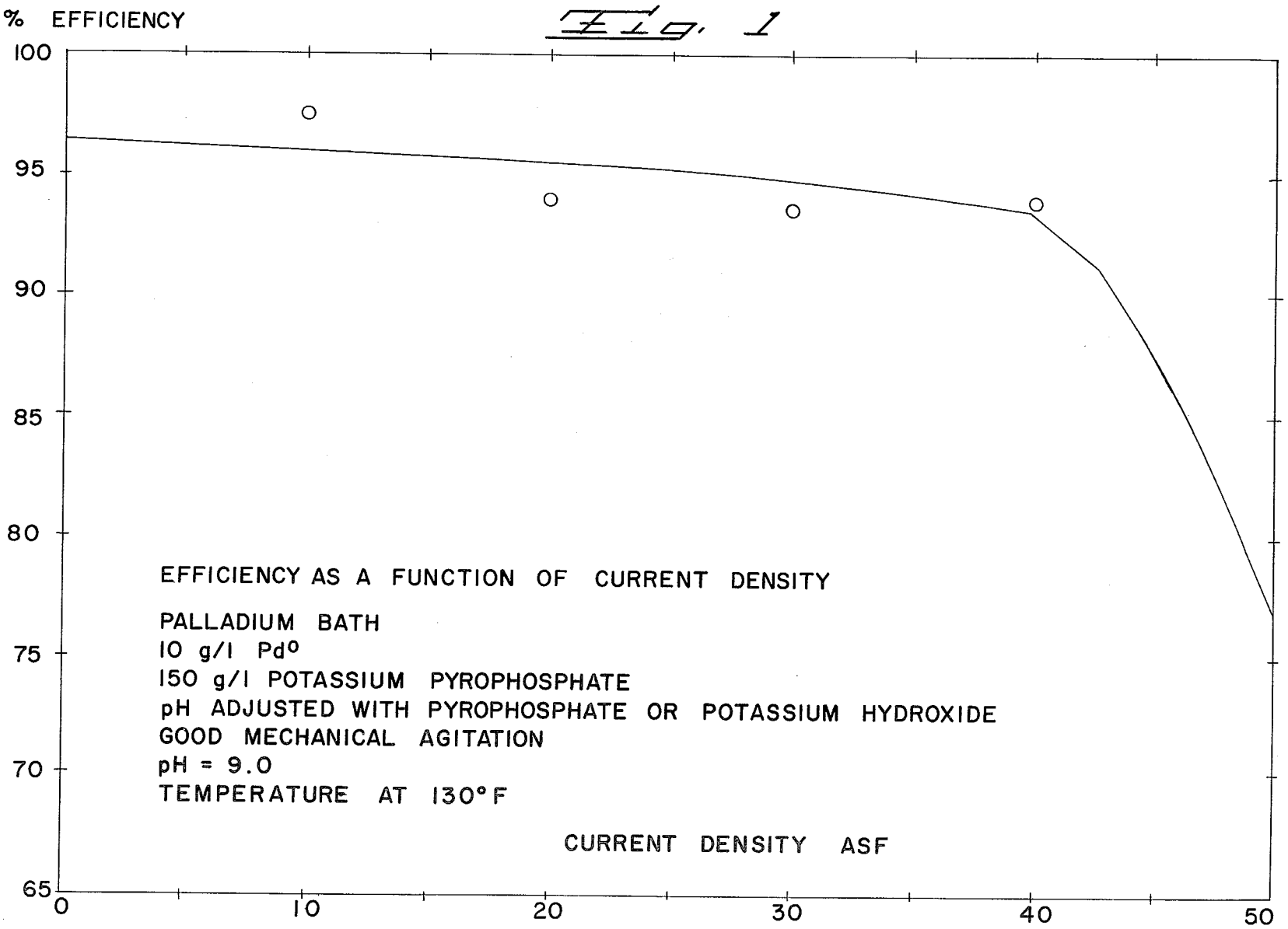

This application is a continuation-in-part application of Ser. No. 742,482, filed Nov. 17, 1976, now abandoned.

BACKGROUND OF THE INVENTION

1. The Field of the Invention

This invention relates to electrodeposition of palladium; more specifically, this invention relates to the deposition of palladium at higher current densities than has heretofore been practicable with available prior art palladium baths and the obtention of higher efficiencies than heretofore observed when plating with conventionally available baths.

2. The Prior Art

It has been known from the prior art that palladium metal can be plated with various electrolyte bath compositions. While U.S. Pat. No. 2,027,358 teaches the deposition of palladium, such as from a double sodium nitrate salt in a solution which is slightly acid, this disclosure also indicates that, of various acids that can be used as an electrolyte, no particular acid or a salt has been revealed which would uniquely and synergistically increase the efficiency.

Thus, it has been a long sought goal to obtain a palladium deposit which could be used as a depost on a base metal at deposition efficiencies such as obtainable with other metals.

Other prior art, such as U.S. Pat. No. 3,530,050, discloses the plating of palladium employing a bath at a pH of 5 to 9 at a temperature from about 50° to 95° C. This disclosure further emphasizes the use of an ammonium salt of a weak organic acid suggesting specifically ammonium formate therefor. Current densities are from 2 to 400 ASF. As reported in this patent, the highest efficiencies are for the low current densities. These efficiencies are only about 85% to a current density of 6 ASF (amperes per square foot).

Other prior art which has been found such as published U.S. patent application No. B435,844, issued Jan. 28, 1975, though it contains a profusion of disclosure of various electrolytes, it fails to disclose the particular combination of elements being claimed herein.

DESCRIPTION OF THE INVENTION AND EMBODIMENTS THEREOF

It has now been found that current efficiency, expressed in the same manner as in the patent to Hill et al., i.e., on the basis of cathode efficiency, has been achieved which is at about 95 percent when depositing at current densities of 2 to 40 ASF with respect to the prior art (and also higher when depositing at a current density of 40 to 50 ASF).

Needless to say, the vastly superior current efficiencies represent a highly unexpected and nonobvious improvement over the prior art processes such as disclosed in the patent to Hill et al., and it is only possible to speculate that it is due to some synergistic interaction of the salt composition in the bath.

In accordance with the present invention, the electrolyte bath which is used for depositing palladium on a base metal consists essentially of palladium metal in the amount of from 4 to 18 grams per liter expressed as elemental metal, but added as $Pd(NH_3)_2(NO_2)_2$. Typically, palladium metal, in the previously mentioned salt, is added in an amount of 8 grams per liter. The palladium metal is expressed on basis of the metal and not as a salt thereof in any reference to the amount of salt being added to the bath.

As the outstanding, superior electrolyte, tetra potassium pyrophosphate is used in an amount from 5 to 300 grams per liter. Typically, an amount of 150 grams per liter expressed as the trihydrated salt is added per liter of the electrolyte solution.

For a suitable pH adjustment to the desired value from 8.5 to 11, pyrophosphoric acid or potassium hydroxide is employed therefor. A pH range from 8.7 to 9.5 is the preferred range.

Operating temperatures are found to be usefully in a range from 120° to 130° F, preferably 125° F. As anodes, insoluble platinum, platinum clad, or tantalum anodes are employed. An anode to cathode ratio of 1:1 as a minimum as employed. The bath is vigorously agitated such as by mechanical means. Current density, as previously mentioned, is from about 2 to 50 ASF; typically, the bath is operated at 20 ASF. The deposition efficiency has been found to be expressed as the cathode efficiency in percent and efficiencies of 95 percent and higher can readily be achieved.

Figure 2:
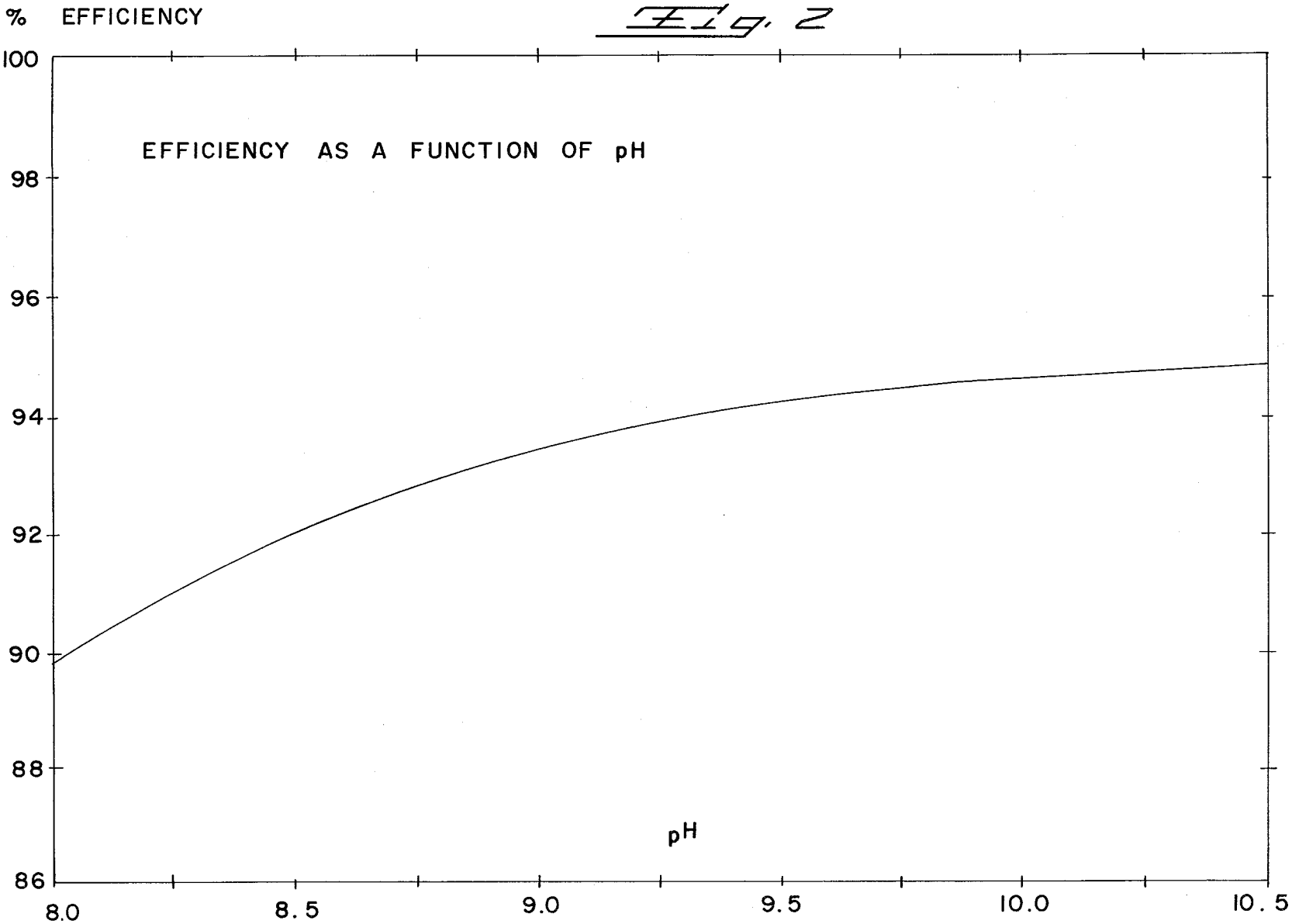

With reference to the drawings which illustrate the invention herein:

FIG. 1 illustrates efficiency as a function of current density for the synergistic combination herein, and FIG. 2 illustrates efficiency as a function of pH for the synergistic combination herein.

These drawings are self-explanatory and provide a graphic illustration of the present invention as embodied in the bath, method of plating, and the salt composition suitable for dilution and use in appropriately pH adjusted aqueous solution.

The above bath has been used for depositing on a base metal, such as copper or various alloys thereof, such as brass, bronze, etc. Other base metals have been used and suitable ones are nickel, silver, steel, or alloys of each, e.g. stainless steel, etc. The deposit of palladium obtained when immersing the workpiece in the above described bath is of an acceptable quality such as with respect to adhesion, brightness, and lack of porosity.

In accordance with the above invention, a workpiece such as electrical contacts, e.g., box and pin contacts, printed circuit board contacts, etc. were plated and the deposit was of high quality. For example, Knoop hardness values (25 gram load) range from 250-300 Knoop units.

EXAMPLE I

A bath was made-up with the following composition and concentrations:

10g/l Pd°
150g/l Potassium Pyrophosphate
130° F temperature
pH=9 adjusted by Pyrophosphate or Potassium Hydroxide This bath was used to rack plate copper coupons at a current density of 20 ASF and with good mechanical agitation. The cathode efficiency was found to be approximately 94%.

EXAMPLE II

At a current density of 40 ASF and with good mechanical agitation using the bath of Example I cathode efficiency was found to be approximately 94% when rack plating copper coupons.

Additional rack plating of copper coupons was conducted using the plating bath of Example I and using current densities of 10 ASF and 30 ASF. The cathode efficiency was found to remain approximately 94%. These results of cathode efficiency as a function of current density is plotted on a graph shown in FIG. 1. By rack plating copper coupons using the plating bath of Example I with good mechanical agitation, the cathode efficiency was found to fall with increasing current density beyond 40 ASF as shown in the graph of FIG. 1.

EXAMPLE III

A plating bath was made-up with the following composition and concentrations:

10g/l Pd°

150g/l Potassium Pyrophosphate

Copper coupons were rack plated in the bath with a current density of 20 ASF at 125° F. Good mechanical agitation was used. Cathode efficiency was found to be 89.3% at a bath pH of 8.0. Pyrophosphate or Potassium Hydroxide was used to adjust pH.

Additional plating baths were made-up with the composition and concentrations of Example III. Pyrophosphate or Potassium Hydroxide was used to adjust pH in the respective additional plating baths. Rack plating was accomplished in each of the additional plating baths under the conditions of Example III, except that a different pH existed for each bath. Cathode efficiency was measured as a function of pH. For example, a bath of 8.5 pH had an efficiency of 92.4%; a bath of 9.0 pH had an efficiency of 94.0%; a bath of 9.5 pH had an efficiency of 93.7%; a bath of 10.0 pH had an efficiency of 94.3%. These results of cathode efficiency in percent as a function of pH are plotted on a graph shown in FIG. 2.

What is claimed is:

1. In a method for plating palladium on a substrate of a metal, the improvement consisting essentially of:

(a) electrolyzing a bath of palladium wherein the same is in an amount from 4 to 18 grams per liter and is added as a seat of $Pd(NH_3)_2(NO_2)_2$, tetra potassium pyrophosphate, in an amount of from 5 to 300 grams per liter and balance water, (b) adjusting the pH to 8.5 to 11 with pyrophosphoric acid or potassium hydroxide, (c) impressing a current between an anode and a workpiece, as a cathode, and (d) electrodepositing palladium on the workpiece sought to be plated at a current density from 2 to 50 ASF, whereby a high cathode efficiency is obtained.

2. The process as defined in claim 1 wherein the electrodepositing is at 125° F at a pH of 8.7 to 9.5, the current density is 20 ASF and the bath is mechanically agitated.

3. The process as defined in claim 1 wherein the base metal on which palladium is plated is copper, nickel, silver, steel, or alloys of each.

4. The process as defined in claim 1 wherein palladium metal is added as $Pd(NH_3)_2(NO_2)_2$ in an amount of 8 grams per liter.

5. An electrolyte bath composition suitable for electrodeposition of palladium on a substrate, said bath comprising: palladium metal, wherein the same is in an amount from 4 to 18 grams per liter and is added as $Pd(NH_3)_2(NO_2)_2$ and tetra potassium pyrophosphate, in an amount from 5 to 300 grams per liter, balance water, and for pH adjustment between 8.5 to 11.0, pyrophosphoric acid, or potassium hydroxide.

6. A salt composition, suitable for dilution as an electrolyte for the electrodeposition of palladium, comprising $Pd(NH_3)_2(NO_2)_2$, $K_4P_2O_7$ and at least one compound selected from the group consisting of pyrophosphoric acid and potassium hydroxide.

* * * * *